US008487242B2

(12) United States Patent
Wenzel et al.

(10) Patent No.: US 8,487,242 B2
(45) Date of Patent: Jul. 16, 2013

(54) DETECTOR DEVICE FOR HIGH MASS ION DETECTION, A METHOD FOR ANALYZING IONS OF HIGH MASS AND A DEVICE FOR SELECTION BETWEEN ION DETECTORS

(75) Inventors: Ryan Wenzel, Zurich (CH); Ulrich Rohling, Ostbevern (DE); Alexis Nazabal, Zurich (CH); Franz Hillenkamp, Munster (DE)

(73) Assignee: Covalx AG, Zurich (CH)

( * ) Notice: Subject to any disclaimer, the term of this patent is extended or adjusted under 35 U.S.C. 154(b) by 277 days.

(21) Appl. No.: 12/811,484

(22) PCT Filed: Jan. 4, 2008

(86) PCT No.: PCT/CH2008/000007

§ 371 (c)(1),
(2), (4) Date: Sep. 16, 2010

(87) PCT Pub. No.: WO2009/086642

PCT Pub. Date: Jul. 16, 2009

(65) Prior Publication Data

US 2011/0001043 A1 Jan. 6, 2011

(51) Int. Cl.
*H01J 49/40* (2006.01)

(52) U.S. Cl.
USPC ..... 250/287; 250/281; 250/282

(58) Field of Classification Search
USPC ..... 250/281, 282, 283, 287, 423 R, 397
See application file for complete search history.

(56) References Cited

U.S. PATENT DOCUMENTS

| | | | | |
|---|---|---|---|---|
| 2003/0141445 | A1* | 7/2003 | Glukhoy | 250/287 |
| 2004/0061054 | A1* | 4/2004 | Kondo et al. | 250/310 |
| 2004/0232835 | A1* | 11/2004 | Keller et al. | 313/533 |
| 2009/0057548 | A1* | 3/2009 | Hidalgo et al. | 250/282 |
| 2009/0090853 | A1* | 4/2009 | Schoen et al. | 250/282 |

* cited by examiner

*Primary Examiner* — Nicole Ippolito
(74) *Attorney, Agent, or Firm* — Sci-Law Strategies, PC

(57) ABSTRACT

Described here is a detector for measuring heavy mass ions with high sensitivity and low saturation for time-of-flight mass spectrometry and a detector housing for selecting between multiple detectors.

28 Claims, 6 Drawing Sheets

DETECTOR DEVICE FOR HIGH MASS ION DETECTION, A METHOD FOR ANALYZING IONS OF HIGH MASS AND A DEVICE FOR SELECTION BETWEEN ION DETECTORS

FIELD OF THE INVENTION

The present invention relates to the field of time-of-flight (TOF) mass spectrometry (MS), and more particularly to matrix-assisted laser desorption ionization (MALDI) TOF MS. It specifically relates to a detection method and device using a conversion dynode followed by a secondary electron multiplier arranged such to allow for detection of all ions including very massive, slow moving macromolecules. It also relates to a device for housing and rapidly selecting between multiple detectors.

BACKGROUND OF THE INVENTION

TOF MS is a fast, efficient and inexpensive technique for discerning the mass of macromolecules. One prominent example for TOF MS is MALDI TOF MS. For MALDI analysis the sample molecules are mixed with a light-absorbing matrix and are vaporized and ionized using a short laser pulse. The molecular ions are then accelerated by a high voltage (+/−10 to 30 kV) through an evacuated tube of a known length and their arrival times at the opposite end are recorded. Measuring the flight time of the molecular ions between the laser pulse (start signal) and the detector signal (stop signal) allows one to calculate the mass to charge ratio of the ions. Because in MALDI the charge of the ions is typically +1, the mass is easily discerned.

Conventional mass spectrometers for biomolecular analysis typically use microchannel plates (MCP) to measure the arrival times of the molecular ions. An ion impacting onto the front surface of the MCP can produce secondary electrons which are then multiplied within the MCP and an output signal as a burst of electrons is measured as current. For large molecules, i.e. exceeding 10,000 atomic mass units, the velocity attained during a typical TOF experiment is typically too low to produce secondary electrons efficiently when impacting on the surface of the MCP. Thus, the detection efficiency of an MCP drops dramatically for large masses in existing TOF MS systems when relying directly upon ion-to-electron conversion, as demonstrated by J. Martens, W. Ens and K. G. Standing in "Proceedings of the ASMS 1991" with a mass of 66,000 u. For example, an organic molecule ion, mostly carbon and hydrogen, with a mass of 50,000 atomic mass units is made up of approximately 5,000 atoms. Even using an acceleration voltage up to 30 kilovolts (the current practical limit), and assuming singly charged particles, as is common in MALDI, only approximately 6 electron volts of kinetic energy is carried on average by each atom. For larger ions in the mass range from 100,000 to 1,000,000 atomic mass units, the energies are even lower and ion detection, therefore, much more difficult.

The generation of secondary electrons at a surface is essentially dependent on the velocity of the impinging ions. The heavy ions fly very slowly and are hardly able to release any secondary electrons upon impact (R. J. Beuhler and L. Friedman, "Threshold Studies of Secondary Electron Emission Induced by Macro-Ion Impact on Solid Surfaces", Nuclear Instr. Methods, 170 (1980) 309-315 309; A. Brunelle, P. Chaurand, S. Della-Negra, Y. Le Beyec and E. Parilis; A. Brunellea, P. Chauranda, S. Della-Negra, Y. Le Beyeca and G. B. Baptista, "Surface secondary electron and secondary ion emission induced by large molecular ion impacts" Int. J. Mass Spectr. Ion Proc. 126 (1993) 65-13;). Large molecules more readily generate secondary ions by a sputtering process, rather than releasing secondary electrons. The utility of existing MALDI TOF MS for studying large biomolecules is therefore severely limited by the lack of detector sensitivity at high masses.

Additionally, because of the basic design of a TOF experiment, lighter mass ions impact the detector first, followed later in time by heavier ions. MCPs are made of an array of tubes or channels, i.e. microchannels, which multiply electrons as they pass through them. Each tube can be considered as an individual dynode with its own dynode resistance on the order of approximately $10^{14}$ Ohm (J. L. Wiza, "Microchannel Plate Detectors", Nuclear Instruments Methods 162 (1979) 587-601). The recovery time for these tubes once discharged is on the order of tens of milliseconds, which is several orders of magnitude longer than the duration of the high mass ions during TOF experiment, which is hundreds of microseconds. (S. Coeck, M. Beck, B. Delaure, V. V. Golovko, M. Herbane, A. Lindroth, S. Kopecky, V. Yu. Kozlov, I. S. Kraev, T. Phalet, N. Severijns, "Microchannel plate response to high-intensity ion bunches", Nuclear Instruments Methods in Physics Res. A, 557 (2006) 516-522). Therefore, once smaller mass ions deplete the charge of an individual channel, that channel is saturated (turned off) for the remainder of the TOF experiment. This saturation effect causes an additional sensitivity bias making it increasingly more difficult to measure high mass ions. This becomes especially problematic in complex sample mixtures such as biologic or polymer samples; however, even relatively pure samples routinely contain multiple signals (i.e. matrix, multimers, multiple charges, adducts) which can cause saturation bias.

Thus, there is need for improving the sensitivity and saturation problems of ion detectors to improve the mass range accessible by MALDI TOF MS.

One method to increase sensitivity for high mass ions is to add a conversion dynode, onto which the ions impact, for use in combination with a standard detector, i.e. MCP, typically used for ions of smaller masses. The conversion dynode can be designed of any surface as in the U.S. Pat. No. 5,202,561 (Giessmann, Hillenkamp, Karas), a flat plate as in DE U.S. Pat. No. 4,129,791 (Holle, A), an MCP as in U.S. Pat. No. 6,051,831 or as a "Venetian blind" as in U.S. Pat. No. 5,463,218 (Holle). This Venetian blind consists of a flat device perpendicular to the ions flight direction made up of a multiple rows of metal stripes, each rotated to approximately 45° to the flight direction, thus creating an impassable barrier for the ions. Behind the Venetian blind, there is an accelerating field which draws out the resulting secondary ions from the Venetian blind and accelerates them toward the ion detector.

These secondary ions which are produced from the Conversion Dynode surface vary in mass typically from 1 to 200 mass units. They must be then reaccelerated and undergo a second minor "time-of-flight" dispersion before impacting a second surface where they can be detected, often by conversion to electrons, which are amplified and finally detected as current through a load resistor. This second "time-of-flight" causes a spread in the impact time relative to the original ion packet because of the differing flight times between the different secondary ion masses.

In U.S. Pat. No. 5,463,218 (Holle) a conversion dynode and a MCP are arranged at a very short distance of a few millimeters from each other in order to minimize for such a time spread. However, the conversion dynode is at ground potential and the potential difference between dynode and MCP, and therefore the acceleration of the secondary ions, is strongly limited due to limited insulation properties. In addition, a scintillator plate is inserted after the MCP, in part to convert electrons into photons to be detected and in another part to insure electrical insulation for the high voltage between the scintillator front end and the detection side. Following the scintillator isolation/conversion process, the photons are detected by a photomultiplier detector to minimize or eliminate saturation of the final signal.

In U.S. Pat. No. 5,202,561 (Giessmann, Hillenkamp and Karas), a method is described by which after impacting the conversion dynode the small secondary ions back away from the conversion dynode, which transfers a more or less uniform energy to them. In addition, there can be a magnetic cross field in front of the conversion dynode which forces the extracted ions onto a circular path which allows them to impact on a multichannel array detector after a 180° deflection for further amplification via secondary electrons. Here a slit is arranged which filters out ions of undesirable masses and allows only the ions of a specific mass to continue flying providing relatively equal flight time for the converted ions. The particles transmitted from the conversion dynode can also be accepted by a secondary electron multiplier arranged in the direction of radiation. However, this rather complicated arrangement including the separation and filtering out of secondary ions drastically limits the sensitivity.

It has been found that the use of conversion dynodes (CD) followed by secondary electron multipliers (SEM) solves some of the sensitivity problems of the TOF MS detection because the CD-SEM detector does not rely on direct ion-to-electron production. However, lack of sensitivity and saturation problems still exist, especially for high mass ion detection.

In another aspect of TOF MS different requirements demand for different detectors. However, to measure ions using different detectors it is necessary to break the vacuum of the mass spectrometer system and physically change the detector. Because the vacuum needed to operate these detectors and mass spectrometers is typically 10^-6 mbar or lower and some systems have to be baked out before reuse, it often takes hours or longer for the mass spectrometer to pump down to these pressures after reaching atmospheric pressure. During this process of changing detectors often the sample will deteriorate making it very difficult to monitor the same sample with different detectors.

Because each detector design exhibits its own advantages and disadvantages, it should be useful to have a device to easily switch between detectors.

SUMMARY OF THE INVENTION

It is therefore the object of the present invention to enhance the detection for high mass ions during mass spectrometry; specifically increasing sensitivity and lower saturation effects when measuring high mass ions. Additionally, a platform for easily changing between detector designs so that multiple detectors can be utilized within the same mass spectrometer on the same sample in a rapid manner.

This object is achieved according to the invention when the detector device for analyzing ions of high mass using a time-of-flight analytical method is fitted onto a mass spectrometer, composed of a source/sample stage including accelerating electrodes and time-of-flight ion separation region used together to create, transmit and separate ions using time-of-flight principals.

The invention is based on the finding that with larger primary ions starting from approximately 3,000 Daltons and ion energies in the range from 10 to 50 keV, increasingly more secondary ions, i.e. mass range up to approximately 200 Daltons, and ever fewer secondary electrons are produced at the initial conversion dynode surface of a secondary electron multiplier or a microchannel plate because of decreasing impact velocity due to increasing mass and decreasing energies. At the same time the yield of sputtered secondary ions increases with the mass of the primary ions. Consequently, a second conversion of these secondary ions into electrons can further be performed for a conventional, efficient amplification of the signal.

When using a TOF MS, which is designed as a simultaneous spectrometer for the ionization and separation of biomolecules covering an unlimited mass range equipped with a detector which uses secondary ion conversion, a broadening of the ion signal is observed. This is caused by different transit times of the various secondary ions emitted from the first conversion dynode on the path to the secondary electron multiplier.

It is therefore preferable to maintain the voltage bias between the conversion dynode and an ion impact surface of the highest possible value, as well as reduce the distance between the surfaces. In order to do this properly, special insulating mechanisms must be employed.

It is therefore a further object of the present invention to provide a conversion dynode followed by a secondary electron multiplier with a specific insulation, so that high voltages can be applied to the conversion dynode element while being located within close proximity to a front surface of a secondary electron multiplier. The purpose of locating within a close proximity is to decrease this secondary ion flight time by both decreasing the flight length and increasing the separation voltage.

This object is achieved by the special construction of the detection unit. The conversion dynode, which is typically kept at a high voltage potential, is mounted on a grounded plate, while insulation elements keep the conversion dynode electrically insulated from said grounded plate. The conversion dynode is also kept electrically isolated from the secondary electron multiplier, however using separate insulation elements. Also the secondary electron multiplier is preferably mounted to the same grounded plate with separate insulation elements keeping the high voltage front side of the electron multiplier electrically insulated from the grounded plate. With this, insulation elements are not located between high voltage elements, but are mounted to a common grounded plane. This separate insolating allows higher voltages to be applied with a minimum separation gap between the conversion dynode and a front of the secondary electron multiplier.

In a preferred embodiment of the invention an arrangement of discrete dynode elements are used as secondary electron multiplier. With this it is possible to specifically reduce or eliminate saturation within the electron multiplier. It is done by an additional capacitance to at least one of the dynode elements of the electron multiplier. Preferably capacitance added between the individual last few dynode elements or between the single dynode elements and ground potential, e.g. the common ground plate.

It is a further object of the inventions to use the superior sensitivity and lowered saturation for efficient detection of slow-moving, massive molecules.

The invention relates to a sensitive measuring method of large masses in the range of about ten thousand to a few million atomic mass units. Specifically it relates to a conversion dynode in a specifically insolated geometry followed by a secondary electron multiplier specifically modified to decrease electron saturation and electronic ringing. Conversion dynode detectors have been used before for time-of-flight mass spectrometry and compared to direct detection with electron multipliers they exhibit superior sensitivity for high-mass, slow-moving macromolecular ions. Using a conversion dynode specifically insolated to a common ground plane has the added capabilities of allowing an increased voltage to be applied to the conversion dynode while maintaining a minimum distance between the conversion dynode and the front of the electron multiplier. This creates faster ion flight time for the secondary ions produced within the detector allowing for higher time resolution and sensitivity from the detector. Also, by adding capacitance as charge buffers to the last few electrodes of a discrete dynode electron multiplier used as the secondary electron multiplier, saturation can be greatly reduced or avoided, which is often a major problem when measuring samples with ions covering a broad mass range.

The invention includes a vacuum chamber for the mounting and selection of multiple detectors which can be placed within the ion flight path in a time-of-flight mass spectrometer. This device provides a platform where multiple detectors, such as the design described herein, can be mounted and utilized in a rapid, reliable and reproducible manner.

The invention specifically details the mechanical selection between multiple detectors, preferably two, without breaking vacuum and with all moving parts housed within the vacuum system. By including all mechanical moving parts within the vacuum chamber the need for larger, expensive and often unreliable mechanical parts to transition the vacuum chamber are not needed, reducing the size, complexity and cost. In addition, the exchange of the detectors can be performed completely electronically.

It should also be beneficial to monitor the position of the detectors within the vacuum and this can easily be done using a position sensor. Once the movement is controlled and the position is determined it is only then necessary to electrically select between the operation of the various detectors. This can easily be done e.g. using signal switching (i.e. relays, switches or other) and adjusting the operating voltages to power the correct detector.

Because all moving parts are housed within the vacuum only electronic connections are required to breach the vacuum chamber, which is much more cost effective and reliable. Additionally, the control of the movement, e.g. a control panel, can easily be moved away from the mass spectrometer detector region and nearer to where the user normally operates the instrument.

The vacuum chamber with mechanical movement can be used with the high mass detector system described to e.g. allow easy comparison between the high mass detector and standard (i.e. MCP) detectors. While a sample unit is often separate and may be opened and ventilated separately, this is not the case with a detection unit. It is therefore also possible and may be useful to mount same kind of detectors. With this a malfunctioning or sensitivity reduction due to an aging process of one detector may be compensated by switching to the other detector without having to ventilate the complete system.

Further advantages, features and details are stated in the figure description below, in which a particularly preferred embodiment is described in detail with references to the drawings.

DETAILED DESCRIPTION OF ILLUSTRATIVE EMBODIMENTS

Figure 1:
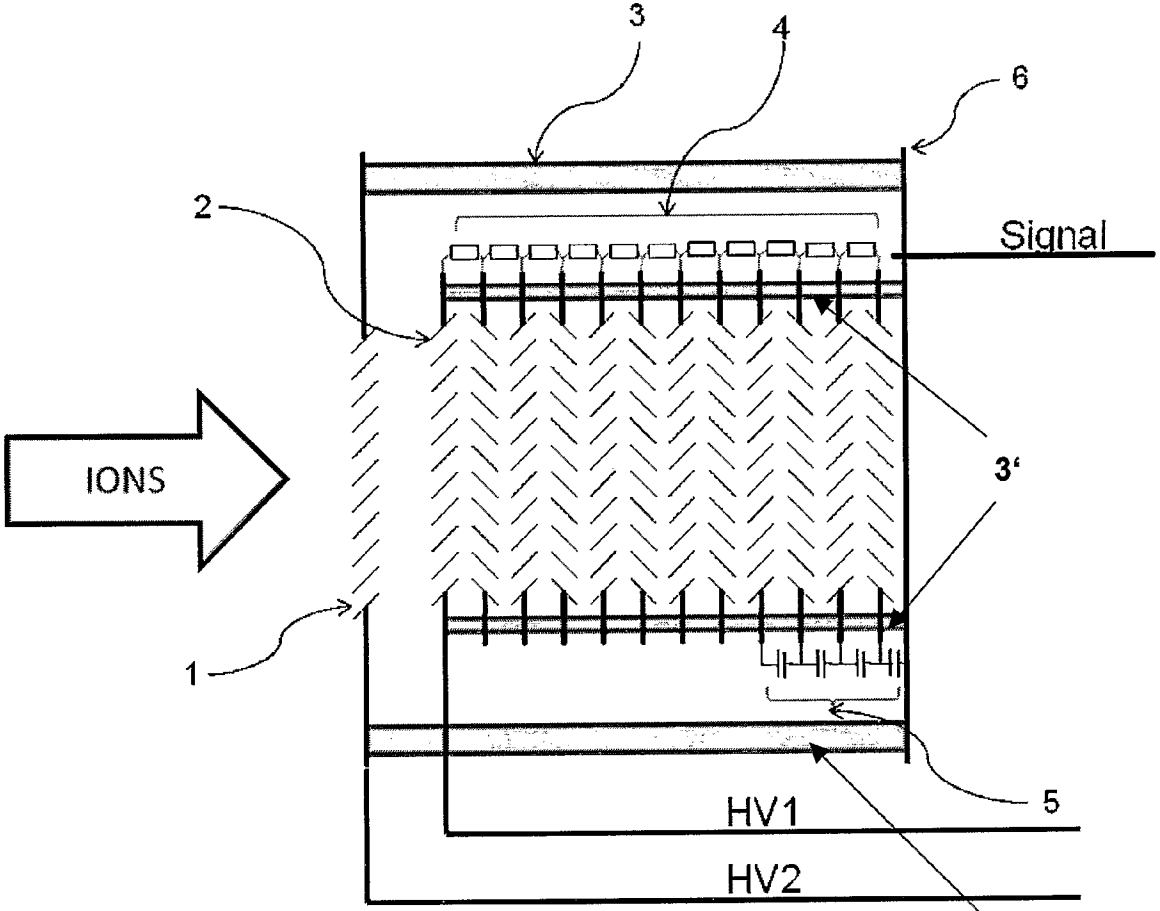
FIG. 1 is a schematic view of a detector according to the invention for a time-of-flight mass spectrometer.

FIG. 1 shows a detector according a preferred embodiment of the invention in schematic form. After traversing the flight route in the time-of-flight mass spectrometer (not shown), the molecular ions impact onto the conversion dynode (1) of the detector, which is at a high electrical potential. To minimize the time spread due to differing flight lengths of the primary ions before impacting the conversion dynode surface, an extremely thin conversion dynode (1), e.g. 0.5-2 mm, is utilized. With current manufacturing technologies, a thickness of less than 1 mm can be accomplished without great difficulty. Preferably, the conversion dynode is shaped into a geometry, which maximizes the extraction yield of secondary ions and minimizes the extraction time as well as the initial velocity spread of the secondary ions. In the example shown in FIG. 1 the sheets of the dynode, which are at approximately 45° to the ion flight path have a thickness of 0.1 mm or thinner. In this preferred embodiment multiple Venetian blind surfaces are attached together creating an impenetrable barrier for the primary ions, still maintaining a minimum thickness. The active area for ion impact and detection is typically between 5 and 30 mm in diagonal, most commonly between 15 and 25 mm.

The secondary ions, which have a typical mass between 1 and about 200 u, are then accelerated from the conversion dynode surface (1) to the first of a series of plates (2) within the electron multiplier. The preferred embodiment utilizes a discrete dynode electron multiplier containing between 8 and 20 plate elements, most preferably 16 plates. The plates or dynode elements are separated by a series of resistors (4).

The conversion dynode surface (1) and the electron multiplier are held physically and electrically insulated from one another using separate insulating devices (3,3'). These are typically manufactured using vacuum compatible insolating ceramics or plastics such as PEEK (polyetheretherketon) or other materials as known in the field. Each insulator is mounted directly to a base ground plate, a common grounded plane (6); the insulation elements are not located between high voltage elements. This separate insolating allows higher voltages (HV1 and HV2) to be applied to the conversion dynode and the front of the secondary electron multiplier combined with a minimum separation gap between the conversion dynode (1) and the front of the secondary electron multiplier (2). With this a high acceleration of the secondary ions and therefore a high yield of electron production at the electron multiplier is possible together with only a small, secondary flight time of the secondary ions which might lead to a smearing of the detector signal.

If properly insolated, distances between conversion dynode and front side of electron multiplier of only a few millimeters, typically between 5 and 20 mm, preferably between 8 and 15, e.g. 12 mm are possible utilizing conversion dynode voltages (HV2) in excess of ±25 kV (depending on the primary ion polarity), with the secondary electron multiplier (HV1) held approximately at −3 kV. If utilizing conversion dynode voltages (HV2) of e.g. only 20 kV distances below 10 mm are possible.

Typical voltages set to the conversion dynodes are between ±30 kV, preferably between ±20 kV, e.g. −20 kV and +15 kV.

Care should be taken with specific concern regarding the insulation separating the different elements of the detector. Adequate spacing should be provided in the vicinity of the high voltage elements. It is advisable to remove or cutout areas on the elements (2,4, and 5) around the insulators (3) to ensure the maximum distance between them and the electron multiplier elements. It is also advisable to use insolating rods which are as long as possible and are connected from the ground plane to the Conversion Dynode to prevent any direct (shorter) connection between the Conversion Dynode and the other elements.

One or several plates, here the final four, of the discrete dynode electron multiplier (5) have additional capacitance added to reduce the charge depletion from earlier arriving ions during the TOF experiment. Preferably a capacitance is utilized over the final 2 to 6 multiplier elements, most preferably over the final 4 elements. Preferably a capacitance has a few nanoFarads to several hundred nanoFarad, with a most preferred embodiment utilizing approximately 10 nF per element. The added capacitances can be connected either between neighboring dynodes, or separately between each single dynode and ground potential. It is understood that these extra capacitive elements are compatible with high voltage and high vacuum as known by those in the business.

It is also possible to use other known conversion dynodes than Venetian blind type and to use a microchannel plate detector instead of a discrete dynode electron multiplier. The inventive insulation arrangement of the detector also allows for an enhanced sensitivity using MCPs. However the discrete dynode electron multiplier opens the possibility to add additional capacitance to one or several of the discrete dynode elements.

In a typical TOF spectrometer the sample is held at a higher potential (typically up to 20 or 25 kV), which is positive for the detection of positive ions and negative for negative ions, whereas the flight tube is at ground potential. In such an arrangement, to measure positive ions, the conversion dynode (1) is preferably held at approximately −20 kV causing incoming ions to be collided at an impact energy comprising the sum of the TOF accelerating potential and that of the conversion dynode. The positive secondary ions generated are then accelerated onto the front dynode of the SEM (2) which is preferably held at approximately −3 kV for the detection of the positive secondary ions.

In the same TOF arrangement, to measure negative ions, the conversion dynode (1) is preferably held at approximately +15 kV causing incoming ions to be collided at an impact energy comprising the sum of the TOF accelerating potential and that of the conversion dynode. The positive secondary ions generated are then accelerated onto the front dynode of the SEM (2) which is preferably held at approximately −3 kV for the detection of the positive secondary ions.

Figure 2:
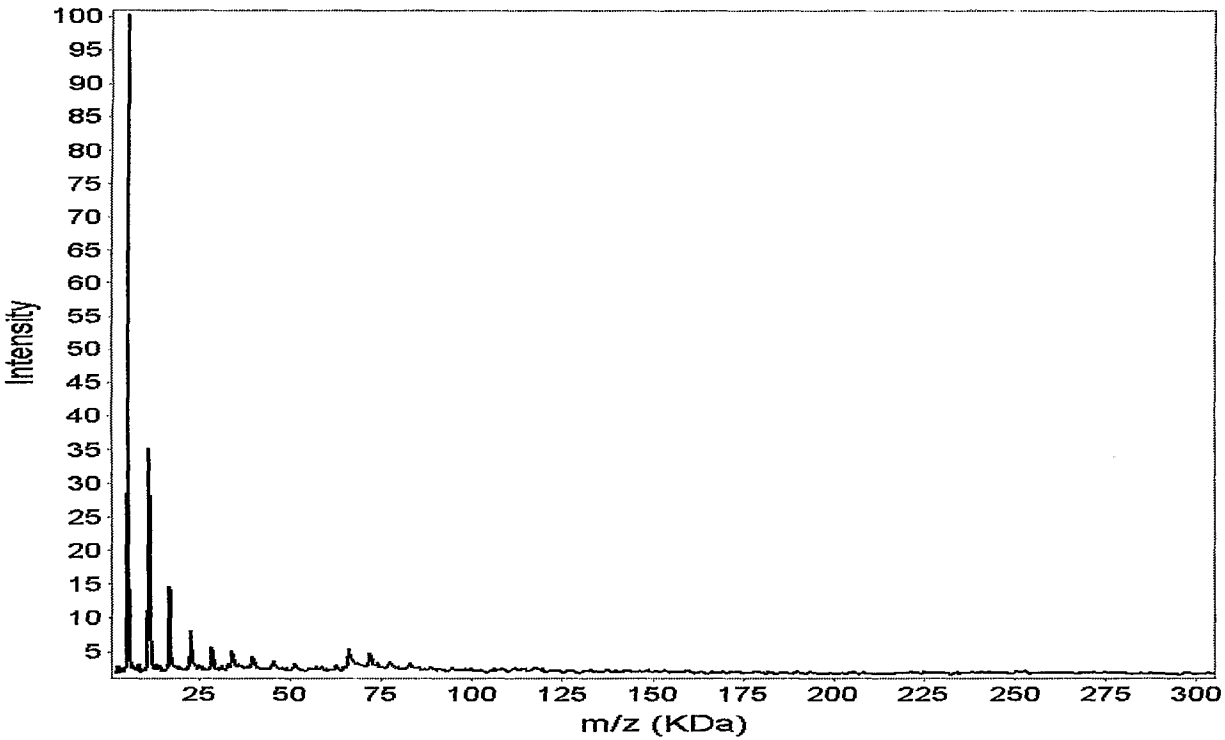
FIGS. 2 and 3 show example spectra of a sample of Insulin mixed with BSA measured with a standard MCP detector (FIG. 2) and with a detector designed according to this invention (FIG. 3).
Figure 3:
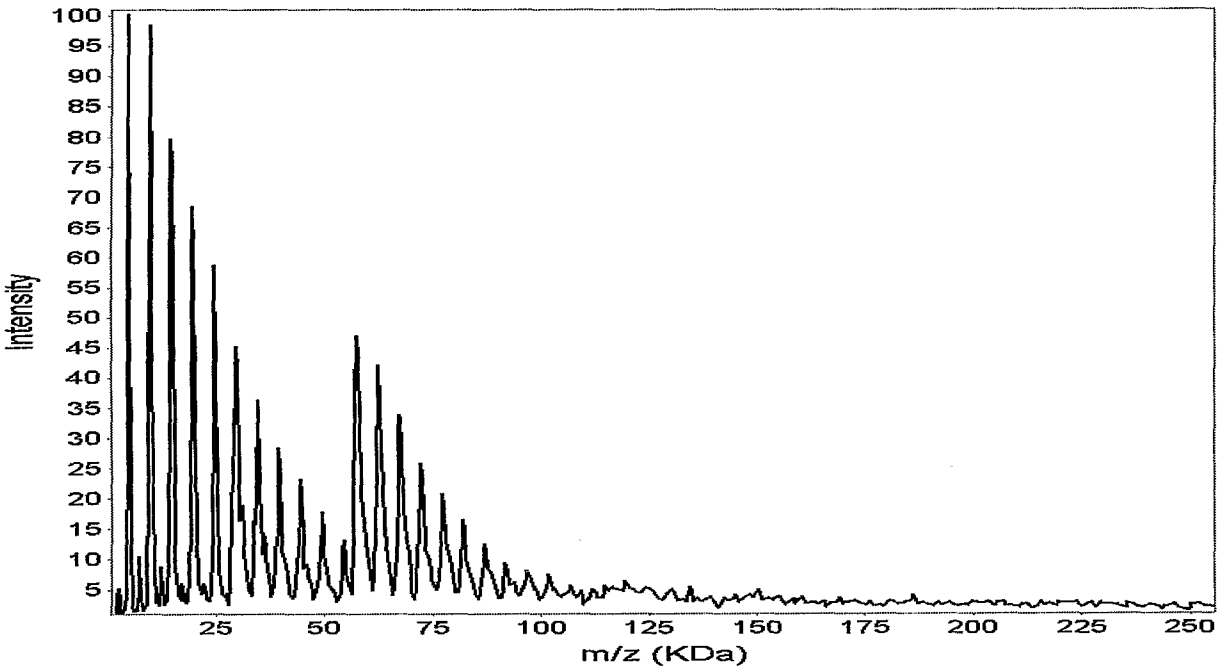

FIGS. 2 and 3 show example spectra of a sample of Insulin mixed with Bovine Serum Albumin (BSA) measured using a standard MCP detector (FIG. 2) and with a high mass detector (FIG. 3) designed according to this invention according to FIG. 1. This data is taken on a commercial MALDI TOF mass spectrometer using 25 kV source acceleration voltage and the detectors were mounted inside a vacuum housing as described in this document so that no instrumental modifications was required while changing between detectors. The presence of the additional peaks between 66 kDa and 110 kDa spectra in FIG. 2 versus FIG. 3 show the effect of saturation upon detection. These peaks are due to the BSA ion and the adducts of insulin homomultimers aggregating within the MALDI plume. The sample, ionization and separation conditions during the TOF experiment were identical between FIGS. 2 and 3. The peaks due to BSA are almost completely missing from FIG. 2 due to detector saturation by the earlier arriving (insulin) ions which impact the MCP detector and saturate many of the channels of the detector causing the detector to be unavailable for detection when the BSA molecules arrive. This demonstrates the improved saturation and sensitivity of a detector designed according to this invention versus a standard MCP detector under identical situations.

Figure 4:
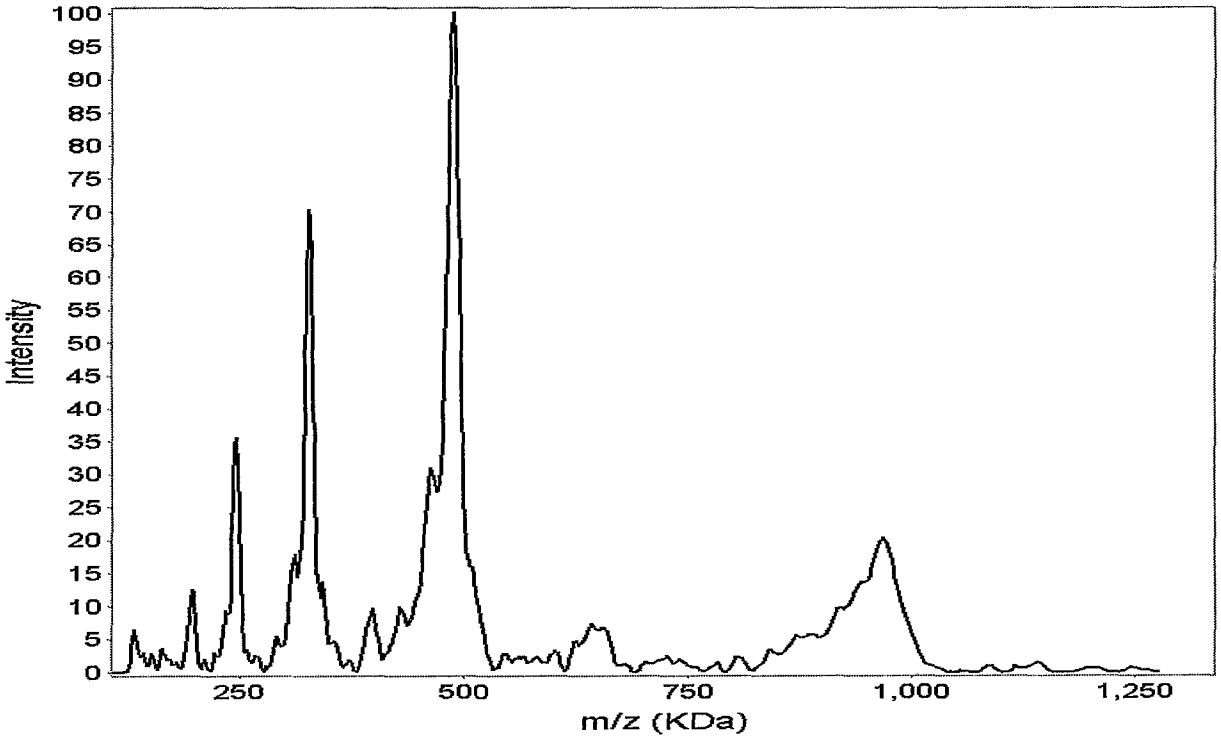
FIG. 4 shows an example spectrum of a sample of Immunoglobulin M (IgM) measuring nearly 1 megadalton in mass taken with a detector designed according to this invention.

FIG. 4 shows an example spectrum of a sample of Immunoglobulin M (IgM) measuring nearly 1 megadalton in mass taken on a detector designed according to this invention as shown to FIG. 1. This data is taken on a commercial MALDI TOF mass spectrometer using 25 kV source acceleration voltage and no instrumental modifications other then the change in detector. The presence of a peak at 1 MDa in FIG. 4 shows the sensitivity for this invention at high masses. This peak is undetectable using standard commercially available ion detectors relying on initial secondary electron conversion.

The mentioned examples are provided to illustrate one or more preferred embodiment of the invention. Numerous variations may be made to these examples without departing from the scope of the present invention. Next to constructional amendments of the described detector, also further variation in the detection set up may be realized. For example, if as an output signal one wishes to use a photodetector as e.g. described in U.S. Pat. No. 5,463,218 one may add a scintillator behind the secondary electron multiplier with adapted voltage circuit as known to one skilled in the art. In some applications it is also desired to have an end of a TOF flight tube also on ground potential as the flight tube itself in order to not disturb a flight route by detector fields. In order to achieve this with a conversion dynode on a high voltage potential, it is possible to add a grid in front of the conversion dynode, which is at the potential of the flight route. However, secondary ions are produced on such a grid, which are accelerated on their way to the conversion dynode, which may lead to an unwanted smearing of a detector signal.

Figure 5:
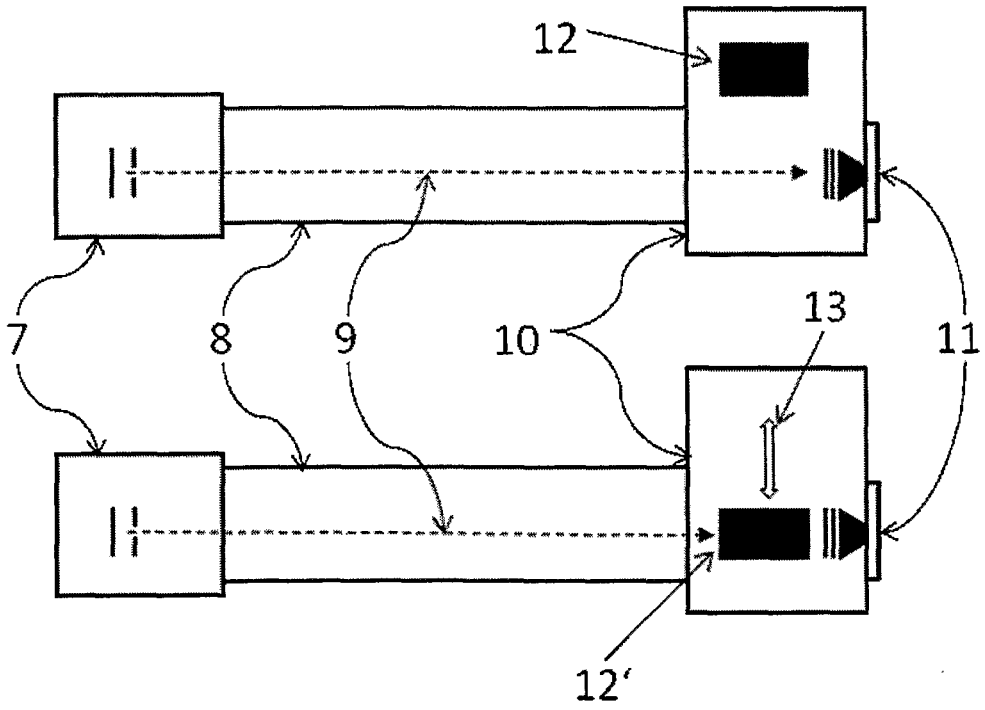
FIG. 5 shows a schematic view of a detector housing which allows selection of multiple detectors for a time-of-flight mass spectrometer.

FIG. 5 shows a schematic view of a detector housing allowing selection from multiple, here two, detectors for a time-of-flight mass spectrometer. The ions are created in the source region (7) of the mass spectrometer, before being accelerated and separated down the time-of-flight region (8) and being detected. FIG. 5 shows a detector housing (10) mounted to the end of the time-of-flight region (8) of the mass spectrometer. The detector housing can move different detectors in front of the ion path (9). In the design shown a standard (i.e. MCP) detector (11) is mounted in a fixed position and an alternative detector such as the high mass detector (12) described herein can be moved in-line of the ion flight path, indicated with arrows (13).

Figure 6:
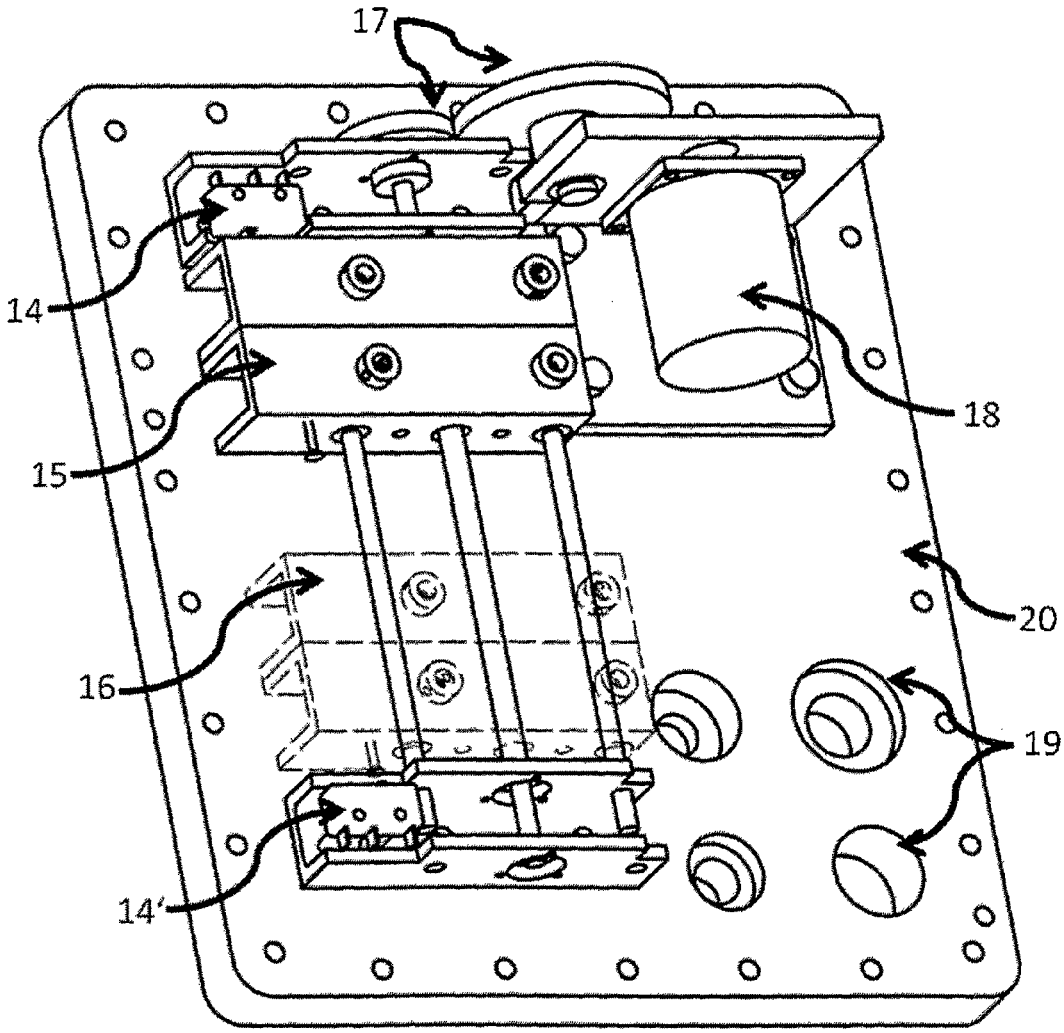
FIG. 6 shows a schematic view of a movement system according to the invention to select between different ion detectors using mechanical components all housed in-vacuum.

FIG. 6 shows a schematic view of a movement system to select between different ion detectors using mechanical components all housed in-vacuum. All components (without detectors) are mounted onto a mounting plate (20) including the feedthrough holes (19) for electrical, high voltage and signal wires. This schematic shows a design where one detector can be mounted (15) and moved in a linear fashion. Special care should be taken in designing the motor (18), drive mechanism (17) and translation stage to be fashioned for operation under high vacuum conditions. This includes using no, or vacuum compatible, lubricant and vacuum compatible materials for all parts, as known by those experienced in the field. This allows the detector to be moved from one position (15) to another position (16) directly in the ion flight path. The actual position of the detector when in an ending state can be monitored using position sensing switches (14,14') or similar devices. By monitoring the position it is possible to allow electronic selection of the ion signal depending on which detector is in operation.

As shown, in the preferred embodiment, the movement is produced through an off-axis motor driven through a selection of gear. Alternatively, belt or other mechanisms could be utilized.

In the preferred embodiment, a screw driven mechanism is used to linearly move the translation stage. Alternatives such as belt driven, push-pull, geared or many others as known to those in the field are also possible.

FIGS. 5 and 6 demonstrate a linear movement allowing selection between one fixed and one moving detector. It is also possible to mount multiple detectors upon the translation stage allowing for selection between more than two detector units, such that the time-of-flight and thereby the mass calibration is unchanged when switching between detectors. In place of linear movements, other (i.e. circular) translation designs could be utilized allowing multiple detectors to be selected in an efficient design.

What is claimed is:

1. A method of analyzing high mass ions in a mass spectrometer comprising the following steps:

a) releasing a vacuum in a time of flight mass spectrometer which includes an ionization region, a flight tube and an existing detection unit, where ions formed in the ionization region pass through the flight tube of the time of flight mass spectrometer with an ion flight path and impact the existing detection unit;

b) mounting to the existing detection unit of the time of flight mass spectrometer a high mass detection unit including a secondary electron multiplier mounted behind a conversion dynode, where the secondary electron multiplier has a front side and a back side, where the front side of the secondary electron multiplier is proximal to the conversion dynode, where the position of the high mass detection unit is moveable, where the high mass detection unit can be positioned to allow ions to impact the existing detection unit by positioning the high mass detection unit not 'in-line', where the high mass detection unit can be positioned to allow ions to impact the high mass detection unit by positioning the high mass detection unit 'in-line';

c) re-establishing the vacuum in the time of flight mass spectrometer; and d) positioning the high mass detection unit in-line with the ion flight path;

e) converting heavy ions which pass through the flight tube of the mass spectrometer with an ion flight path into lighter, secondary ions, by impingement of the heavy ions on the conversion dynode which allows transmission of the secondary ions;

f) accelerating the lighter secondary ions towards the secondary electron multiplier by applying a potential difference between the conversion dynode and the front side of the secondary electron multiplier;

g) converting the secondary ions into electrons upon impingement of the secondary ions on surfaces of the secondary electron multiplier; and h) multiplying a number of electrons inside the secondary electron multiplier by applying a potential difference between the front side and the back side of the electron multiplier to analyze high mass ions.

2. The method according to claim 1, comprising the further step of mounting the secondary electron multiplier to the common grounded plane.

3. The method according to claim 1, comprising the further step of measuring the electrons as signal output.

4. The method according to claim 1, where the conversion dynode is set at a high voltage potential.

5. The method according to claim 1, where a voltage difference between the conversion dynode and the front side of secondary electron multiplier is at least 5 kV.

6. The method according to claim 1, where a distance between the conversion dynode and the secondary electron multiplier is 20 mm or less.

7. The method according to claim 1, where the secondary electron multiplier comprises a plurality of successive dynode elements and a potential difference is applied between each of the plurality of successive dynode elements.

8. The method according to claim 7, where the secondary electron multiplier has additional capacitance added to at least one of the dynode elements.

9. The method according to claim 8, where the capacitance is added to a final two to six dynode elements.

10. The method according to claim 8, where the additional capacitance is connected between neighboring dynode elements or between the single dynode elements and ground potential.

11. The method according to claim 1, where the conversion dynode is comprised of a Venetian blind type conversion dynode.

12. The method according to claim 1, where the step of applying a potential difference between the conversion dynode and the front side of the secondary electron multiplier comprises applying the potential difference such that the potential difference is switchable between two polarities to allow acceleration of positive ions and one or both negative ions and electrons.

13. A high mass ion detection unit comprising:

a conversion dynode for converting heavy ions formed with a time-of-flight mass spectrometer into lighter secondary ions, where the time-of-flight mass spectrometer includes an ionization region, a flight tube and an existing detection unit, where ions formed in the ionization region pass through the flight tube of the time of flight mass spectrometer with an ion flight path and impact the existing detection unit;

a discrete dynode secondary electron multiplier for converting the secondary ions into electrons and for multiplying the number of electrons inside the discrete dynode secondary electron multiplier, where the discrete dynode secondary electron multiplier includes a front side and a rear side; and a moveable mounting plate, where the conversion dynode is mounted on the mounting plate, where the discrete dynode secondary electron multiplier is mounted on the mounting plate, where the mounting plate has a common ground, where the conversion dynode is electrically insulated from the mounting plate, where the moveable mounting plate can be positioned to allow ions to impact the existing detection unit by positioning the moveable mounting plate not 'in-line', where the moveable mounting plate can be positioned to allow ions to impact the conversion dynode by positioning the moveable mounting plate 'in-line'.

14. The device according to claim 13, where the secondary electron multiplier is mounted to the common grounded plane and a front side of the secondary electron multiplier is electrically insulated from the grounded plane.

15. The device according to claim 13, where the conversion dynode is a Venetian blind type conversion dynode.

16. The device according to claim 13, where the secondary electron multiplier comprises a plurality of successive dynode elements.

17. The device according to claim 16, where the secondary electron multiplier has additional capacitance added to at least one of the dynode elements.

18. The device according to claim 17, where the additional capacitance is added to a final two to a final six dynode elements of the discrete dynode secondary electron multiplier.

19. The device according to claim 17, where the additional capacitance is connected between neighboring dynode elements or between the single dynode elements and the common grounded plane.

20. The device according to claim 13, where a potential difference between conversion dynode and the discrete dynode secondary electron multiplier is set, such that the potential difference is switchable between two polarities to allow for an acceleration and detection of positive and negative ions.

21. The device according to claim 13, where a distance between the conversion dynode and the front side of the discrete dynode secondary electron multiplier is 20 mm or less.

22. The device according to claim 13, where a voltage difference between the conversion dynode and the front side of the discrete dynode secondary electron multiplier is at least 5 kV.

23. A device for selecting one or more ion detectors to be used with a time-of-flight mass spectrometer comprising:

a vacuum housing for housing the one or more ion detectors; and a mechanical movement apparatus that can be moved into an ion flight path of the time-of-flight mass spectrometer, where moving the mechanical movement apparatus into an ion flight path of the time of flight mass spectrometer blocks the ion flight path from reaching one of the one or more ion detectors, where at least one of the one or more ion detectors is mounted on the mechanical movement apparatus, where the mechanical movement apparatus includes a drive mechanism for adjusting the position of the one or more ion detectors mounted on the mechanical movement apparatus, where the mechanical movement apparatus and the drive mechanism are housed entirely within the vacuum housing.

24. The device according to claim 23, where two or more detectors are arranged in the vacuum housing.

25. The device according to claim 23, further including a detection device for detecting a detector position within the vacuum housing.

26. The device according to claim 23, further including signal switching to control switching of signal path between ion detectors.

27. The device according to claim 23, where one of the one or more ion detectors is a detector device for high mass ion detection to be used with a time-of-flight mass spectrometer comprising:

a conversion dynode for converting heavy ions into lighter secondary ions;

a secondary electron multiplier for converting said secondary ions into electrons and for multiplying the number of electrons inside the secondary electron multiplier; and a signal output, where the conversion dynode is mounted on a common grounded plane and electrically insulated from the common grounded plane by an electrical insulation between the conversion dynode and the common grounded plane.

28. The device according to claim 23, where the one or more ion detectors are moved in-line with the ion flight path.

* * * * *